US012577483B2

(12) United States Patent
Arai

(10) Patent No.: US 12,577,483 B2
(45) Date of Patent: Mar. 17, 2026

(54) GASOLINE PRODUCTION APPARATUS

(71) Applicant: Honda Motor Co., Ltd., Tokyo (JP)

(72) Inventor: Takuma Arai, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 123 days.

(21) Appl. No.: 18/587,591

(22) Filed: Feb. 26, 2024

(65) Prior Publication Data

US 2024/0327737 A1 Oct. 3, 2024

(30) Foreign Application Priority Data

Mar. 31, 2023 (JP) ..... 2023-056940

(51) Int. Cl.
*C10L 1/02* (2006.01)

(52) U.S. Cl.
CPC ..... *C10L 1/023* (2013.01); *C10L 2200/0415* (2013.01); *C10L 2200/0423* (2013.01); *C10L 2270/023* (2013.01)

(58) Field of Classification Search
CPC ..... C10G 2300/305; C10G 2400/02; C10L 1/023; C10L 1/06; C10L 2200/0415; C10L 2200/0423; C10L 2270/023
See application file for complete search history.

(56) References Cited

FOREIGN PATENT DOCUMENTS

| | | | | |
|---|---|---|---|---|
| JP | 2007270091 A | * | 10/2007 | |
| JP | 2013001846 A | | 1/2013 | |
| JP | 2015044926 A | | 3/2015 | |
| WO | WO-2018029606 A1 | * | 2/2018 | ..... C10G 35/04 |

OTHER PUBLICATIONS

JP2007270091 English Translation (Year: 2007).*
Japanese Office action; Application 2023-056940; pp. 1-8; Nov. 26, 2024.

* cited by examiner

*Primary Examiner* — Ellen M Mcavoy
*Assistant Examiner* — Chantel Graham
(74) *Attorney, Agent, or Firm* — Duft & Bornsen, PC

(57) ABSTRACT

A gasoline production apparatus includes: a mixer configured to mix first FT naphtha containing olefins and second FT naphtha containing no olefins to produce mixed fuel having a predetermined olefin content.

8 Claims, 7 Drawing Sheets

GASOLINE PRODUCTION APPARATUS

CROSS-REFERENCE TO RELATED APPLICATION

This application is based upon and claims the benefit of priority from Japanese Patent Application No. 2023-056940 filed on Mar. 31, 2023, the content of which is incorporated herein by reference.

BACKGROUND OF THE INVENTION

Field of the Invention

The present invention relates to a gasoline production apparatus configured to produce gasoline as a renewable fuel.

Description of the Related Art

In the related art, apparatuses for producing hydrocarbons such as gasoline from carbon dioxide and hydrogen have been known. For example, in an apparatus described in JP 2015-044926 A, water is removed from a mixed gas containing carbon monoxide, carbon dioxide, hydrogen, and water, which is obtained by reacting carbon dioxide and hydrogen, and hydrocarbons having 2 or more carbon atoms are produced via methanol.

In the apparatus described in JP 2015-044926 A, hydrocarbons are produced via methanol, but methanol is toxic and the entire amount of methanol needs to be converted when used as a fuel such as gasoline. Therefore, a lot of energy is required, and it is difficult to efficiently produce hydrocarbons.

SUMMARY OF THE INVENTION

An aspect of the present invention is a gasoline production apparatus, including: a mixer configured to mix first FT naphtha containing olefins and second FT naphtha containing no olefins to produce mixed fuel having a predetermined olefin content.

BRIEF DESCRIPTION OF THE DRAWINGS

The objects, features, and advantages of the present invention will become clearer from the following description of embodiments in relation to the attached drawings, in which.

DETAILED DESCRIPTION OF THE INVENTION

Hereinafter, an embodiment of the present invention will be described with reference to FIGS. 1 to 6. A gasoline production apparatus according to an embodiment of the present invention fractionates FT crude oil obtained by Fischer-Tropsch (FT) synthesis using renewable power into FT naphtha, FT kerosene, FT diesel, and the like, and produces gasoline as a renewable fuel from the FT naphtha.

The average global temperature is maintained in a warm range suitable for organisms by greenhouse gases in the atmosphere. Specifically, some of the heat radiated from the ground surface heated by sunlight to outer space is absorbed by greenhouse gases and re-radiated to the ground surface, whereby the atmosphere is maintained in a warm state. Increasing concentrations of greenhouse gases in the atmosphere cause a rise in average global temperature (global warming).

Carbon dioxide is a greenhouse gas that greatly contributes to global warming, and its concentration in the atmosphere depends on the balance between carbon fixed on or in the ground in the form of plants or fossil fuels and carbon present in the atmosphere in the form of carbon dioxide. For example, carbon dioxide in the atmosphere is absorbed through photosynthesis in the growth process of plants, causing a decrease in the concentration of carbon dioxide in the atmosphere. Carbon dioxide is also released into the atmosphere through combustion of fossil fuels, causing an increase in the concentration of carbon dioxide in the atmosphere. In order to mitigate global warming, it is necessary to replace fossil fuels with renewable energy sources such as sunlight, wind power, water power, geothermal heat, or biomass to reduce carbon emissions.

Figure 1:
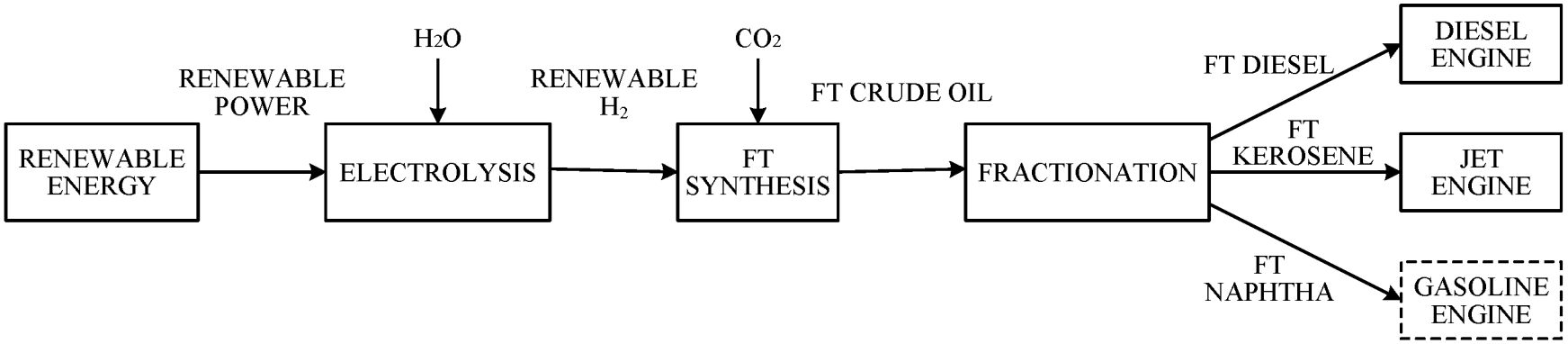
FIG. 1 is a diagram for explaining renewable fuels produced using renewable energy.

FIG. 1 is a diagram for explaining renewable fuels produced using such renewable energy. As illustrated in FIG. 1, renewable power is generated by solar power generation, wind power generation, water power generation, geothermal power generation, or the like, and water is electrolyzed by renewable power into renewable hydrogen. Furthermore, renewable hydrogen and carbon dioxide recovered from gas emissions from factories and the like are used to produce renewable fuels through FT synthesis or methanol synthesis. Since methanol is toxic, when gasoline is produced via methanol, the entire amount of methanol needs to be converted, and a lot of energy is required.

FT crude oil obtained by FT synthesis contains various components, given the principles of the FT synthesis process as a polymerization reaction. Such FT crude oil is fractionated according to the range of boiling points and separated into FT diesel, FT kerosene, FT naphtha, and the like. Among them, FT diesel and FT kerosene can be directly used as a fuel for diesel engines and a fuel for jet engines, respectively.

FT naphtha mainly contains normal paraffin having about 5 to 9 carbon atoms. In addition, FT naphtha accessorily contains olefins at a content ratio that depends on the catalyst, reaction temperature, reaction time, and the like used in the FT synthesis process. Such FT naphtha is suitable as a base material for gasoline because its vapor pressure characteristic (vaporization characteristic) conforms to the gasoline standard. On the other hand, FT naphtha has an octane number (research octane number) of about 50 to 80, which is lower than the gasoline standard (about 90). Therefore, the direct use of FT naphtha as a fuel for gasoline engines may cause knocking that leads to impaired engine combustion performance.

In the related art, a part of naphtha obtained by fractionation of crude oil is catalytically reformed to isoparaffin or aromatic hydrocarbons, and is mixed with olefins obtained by catalytic cracking of a heavy oil component obtained by fractionation of crude oil or alkylate obtained by alkylation to improve the octane number. However, since the FT synthesis for producing a renewable fuel is performed under the condition that a yield of FT kerosene or the like is high, the FT crude oil contains almost no heavy oil component, and it is difficult to improve the octane number by mixing olefins and the like obtained by catalytic cracking of the heavy oil component with FT naphtha. In addition, it is difficult to efficiently improve the octane number when increasing a ratio of catalytic reforming of naphtha to aromatic hydrocarbons.

Figure 2:
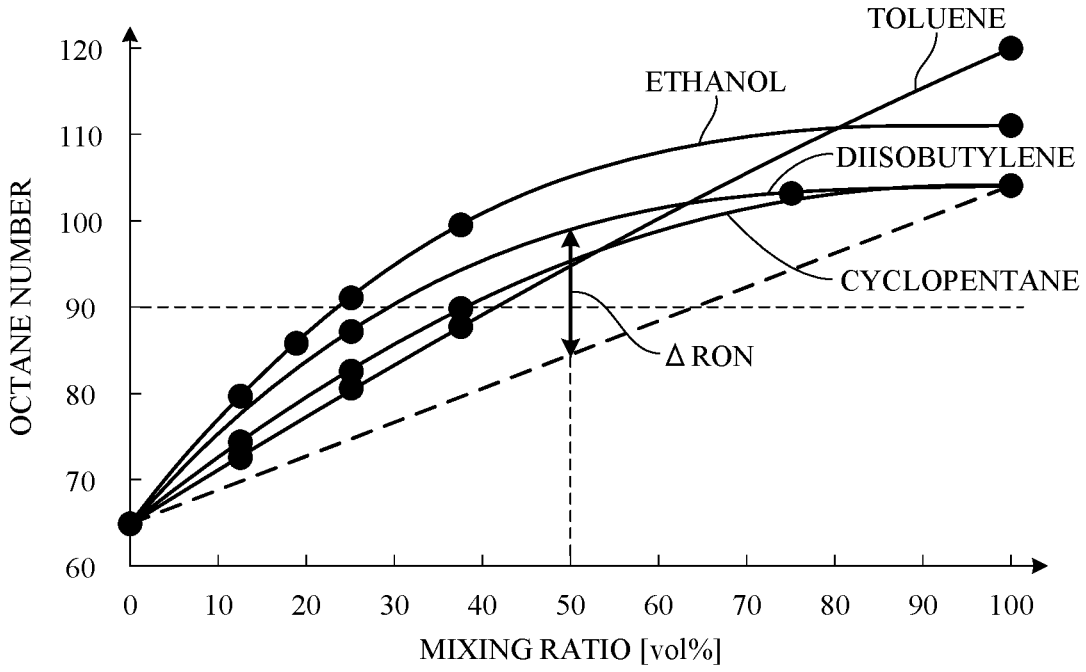
FIG. 2 is a diagram for explaining an octane number improver.

FIG. 2 is a diagram for explaining an octane number improver, and illustrates an example of a measurement result of an octane number of a mixed fuel obtained by mixing various octane number improvers with a primary reference fuel (PRF) 65 having an octane number of 65 obtained by mixing isooctane and normal heptane at a volume ratio of 65:35. As illustrated in FIG. 2, when toluene (aromatic hydrocarbon) is mixed as an octane number improver, the mixing amount required to improve the octane number to gasoline standard (about 90) is larger than that when ethanol or diisobutylene (olefin) is mixed.

A hydrocarbon combustion reaction is a chain reaction that proceeds by production and consumption of OH radicals, and in the case of combustion alone, the initial combustion reaction is suppressed and the octane number becomes higher in a hydrocarbon from which it is difficult to extract hydrogen atoms and it is difficult to produce OH radicals. For example, isooctane having a side chain has a higher octane number than normal heptane having a straight chain.

The olefin is an unsaturated hydrocarbon having one double bond, and the olefin having 3 or more carbon atoms has an allyl group ($—CH_2CH{=}CH_2$). The binding energy between the carbon atom and the hydrogen atom adjacent to the double bond of the allyl group is low, and the hydrogen atom is easily extracted. When such an olefin is mixed with a hydrocarbon base material as an octane number improver, OH radicals produced in the initial combustion reaction of the hydrocarbon base material are consumed by preferentially reacting with the hydrogen atom extracted from the allyl group of the olefin, and the combustion reaction (chain reaction) is suppressed. In addition, the olefin itself exists in a stable state even after the hydrogen atom is extracted by allyl resonance stabilization, and it is difficult to produce OH radicals. That is, the olefin not only has a high octane number as a simple substance, but also has an effect of suppressing the combustion reaction by consuming OH radicals produced in the initial combustion reaction of the hydrocarbon base material and improving the octane number when mixed with the hydrocarbon base material (synergistic effect).

Therefore, when an olefin is mixed with an FT naphtha base material mainly containing normal paraffin, the octane number is improved to a value equal to or more than a value predicted according to both the octane number and the mixing ratio by the synergistic effect. On the other hand, even when toluene is mixed with the FT naphtha base material, the octane number is improved only up to a value predicted according to both the octane number and the mixing ratio. Therefore, in the present embodiment, a gasoline production apparatus is configured as follows so that gasoline as a renewable fuel can be efficiently produced by utilizing an octane number improving synergistic effect by olefins.

Figure 3A:
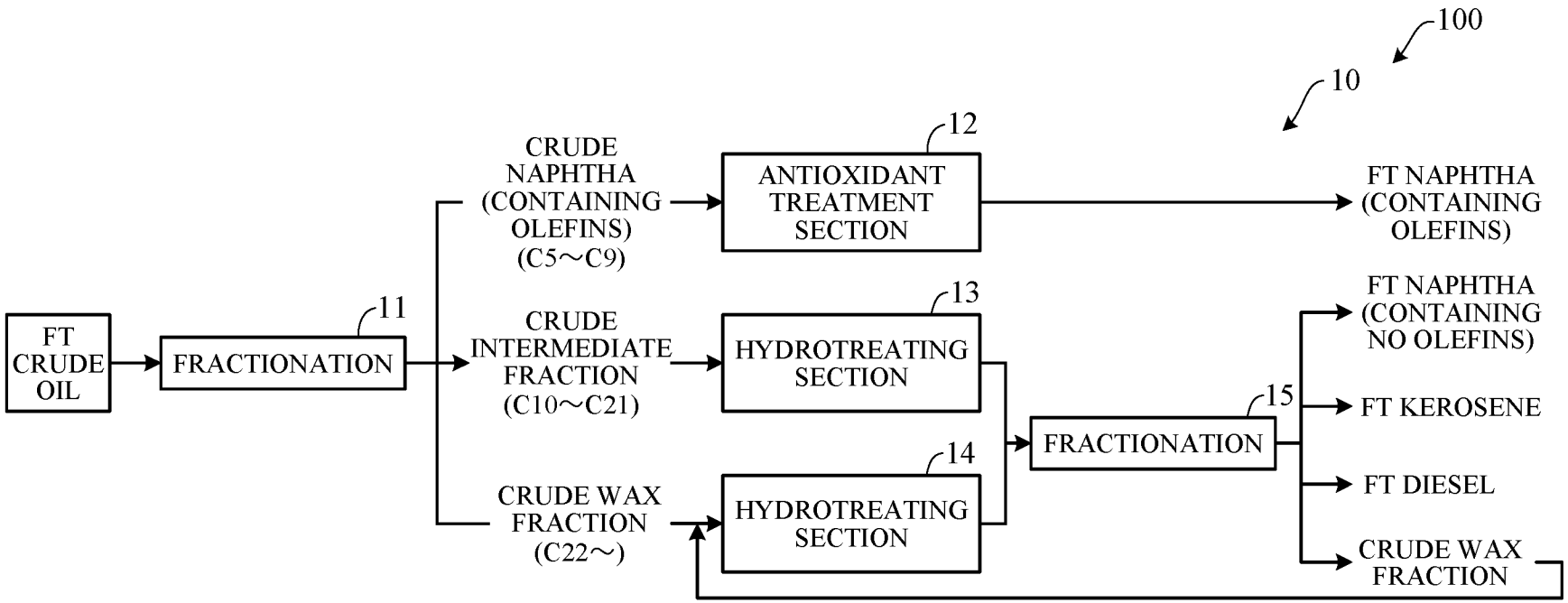
FIG. 3A is a block diagram illustrating an example of a configuration of a fractionation unit of a gasoline production apparatus according to an embodiment of the present invention.
Figure 3B:
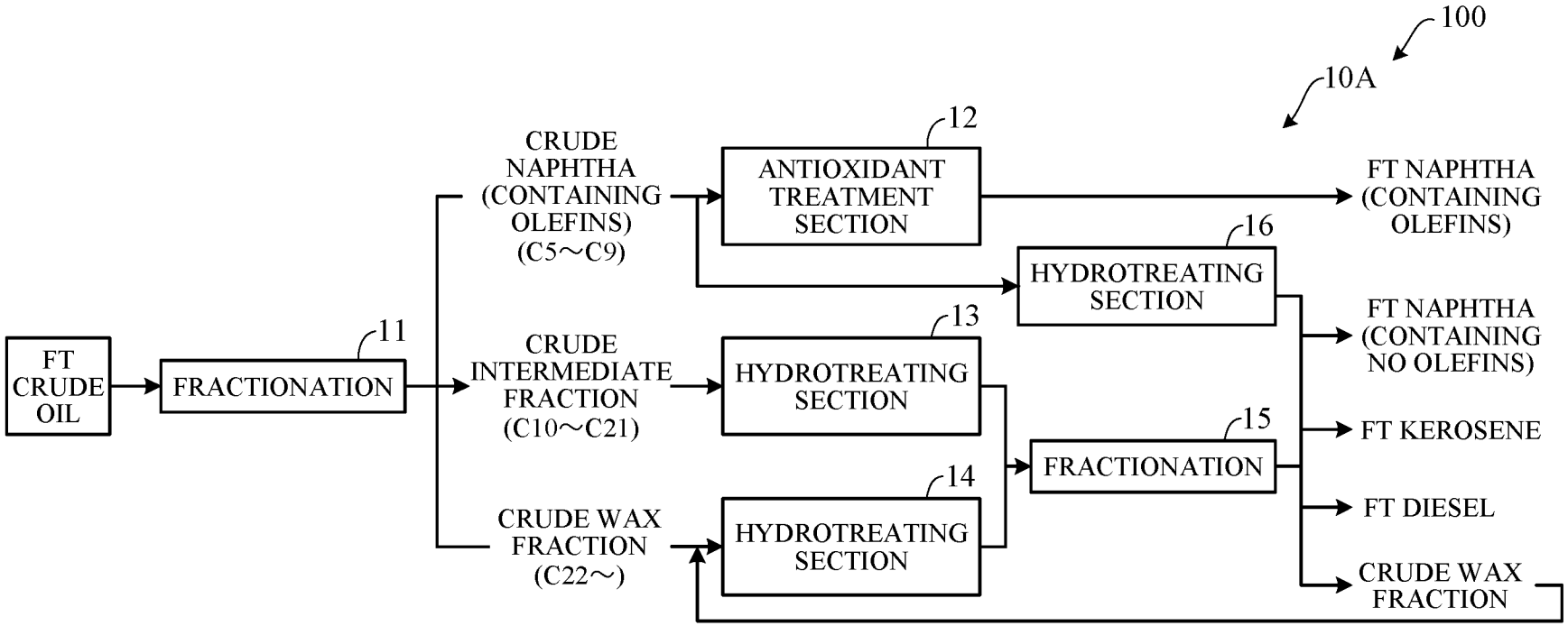
FIG. 3B is a block diagram illustrating another example of a configuration of a fractionation unit of the gasoline production apparatus according to the embodiment of the present invention.

FIGS. 3A and 3B are block diagrams illustrating examples of a configuration of fractionation units 10 and 10A of a gasoline production apparatus (hereinafter, an apparatus) 100 according to an embodiment of the present invention. As illustrated in FIG. 3A, the fractionation unit 10 includes a first distillation column 11, an antioxidant treatment section 12, hydrotreating sections 13 and 14, and a second distillation column 15. The first distillation column 11 is supplied with FT crude oil as a renewable fuel obtained by FT synthesis from $CO_2$ as a by-product when bioethanol is produced from biomass such as corn and hydrogen obtained by electrolysis of water using renewable energy.

In the first distillation column 11, the FT crude oil is fractionated into crude naphtha (5 to 9 carbon atoms) containing olefins and having a boiling point of 150° C. or lower, a crude intermediate fraction (10 to 21 carbon atoms) having a boiling point of 150° C. to 360° C., and a crude wax fraction (22 carbon atoms or more) having a boiling point of 360° C. or higher. The crude naphtha is supplied to the antioxidant treatment section 12, the crude intermediate fraction is supplied to the hydrotreating section 13, and the crude wax fraction is supplied to the hydrotreating section 14.

Figure 5:
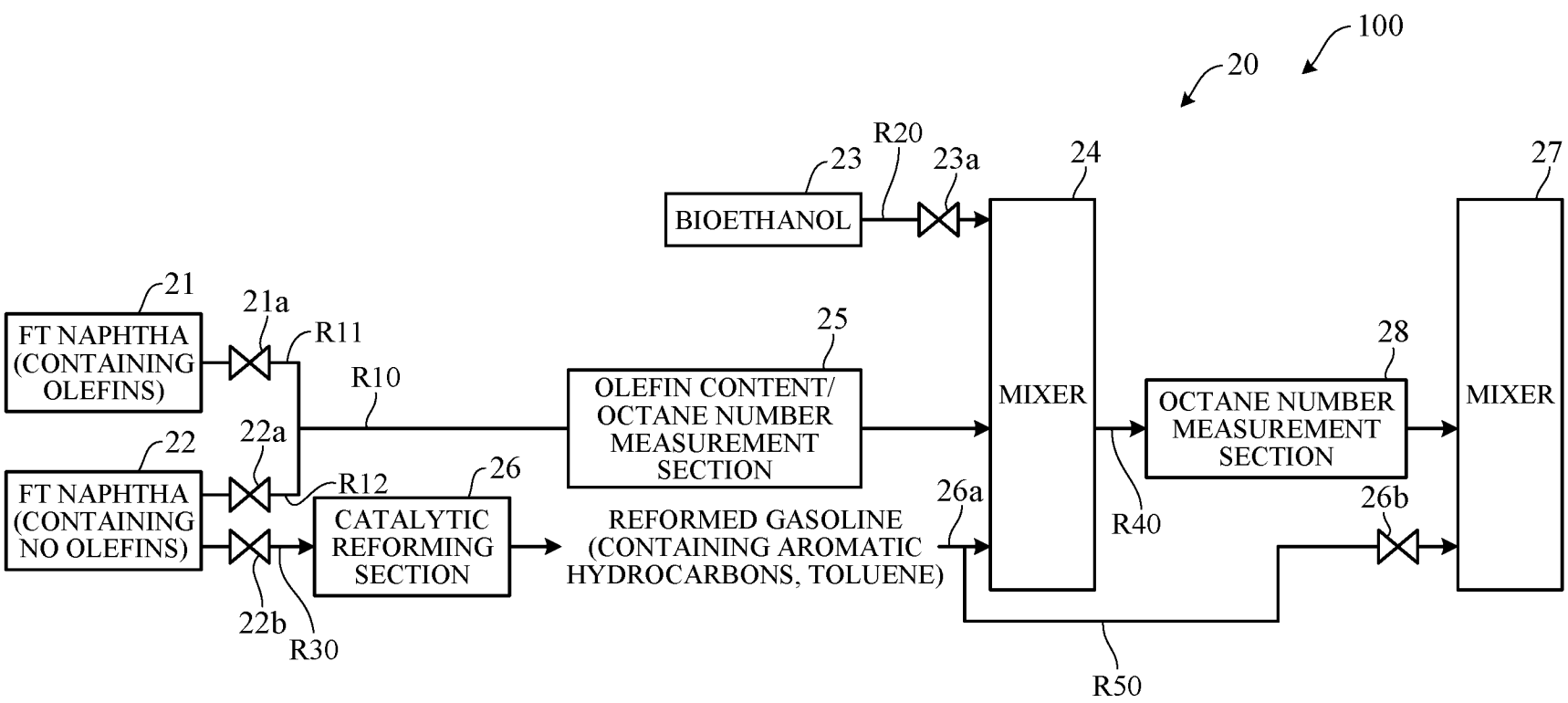
FIG. 5 is a block diagram illustrating an example of a configuration of a mixing unit of the gasoline production apparatus according to the embodiment of the present invention.

The antioxidant treatment section 12 is provided in proximity to the first distillation column 11, adds an extremely small amount (about several ppm) of an antioxidant such as dibutylhydroxytoluene (BHT) to the crude naphtha immediately after fractionated in the first distillation column 11, and supplies the crude naphtha to a storage section 21 (FIG. 5). The antioxidant treatment section 12 can be provided, for example, in a condenser that condenses vapor of crude naphtha discharged from the first distillation column 11.

In the related art, the naphtha fraction obtained by fractionating crude oil was first subjected to hydrotreating, and then, a part of the naphtha fraction was catalytically reformed to isoparaffin or aromatic hydrocarbons, and olefins and the like obtained by catalytically cracking heavy oil fractions were mixed, thereby improving the octane number. At this time, the olefins contained in the naphtha fraction immediately after fractionation were converted into paraffin by hydrogenation (addition reaction), such that the octane number of the naphtha fraction was reduced, and the octane number was improved by catalytic reforming or mixing of the olefins via the heavy oil fractions so as to compensate for the reduction.

By utilizing the crude naphtha fraction containing olefins without hydrogenation, the octane number can be efficiently improved. In addition, an antioxidant is added to the crude naphtha fraction immediately after fractionation, such that oxidation of olefins can be prevented, and a decrease in octane number due to a decrease in olefins can be prevented.

The hydrotreating sections 13 and 14 hydrogenate the crude intermediate fraction and the crude wax fraction fractionated in the first distillation column 11, respectively, and supply these hydrogenated fractions to the second distillation column 15. In the hydrotreating sections 13 and 14, renewable hydrogen is used.

In the second distillation column 15, the hydrogenated crude intermediate fraction and crude wax fraction are fractionated into FT naphtha containing no olefins, FT kerosene, FT diesel, and a wax fraction. Among the fractions obtained from the second distillation column 15, the FT naphtha containing no olefins is supplied to a storage section 22 (FIG. 5), and the wax fraction is supplied to the hydrotreating section 14 and hydrogenated again.

As illustrated in FIG. 3B, the fractionation unit 10A includes, in addition to the configuration of the fractionation unit 10 in FIG. 3A, a hydrotreating section 16 that hydrogenates a part of the crude naphtha fractionated in the first distillation column 11 and supplies the hydrogenated naphtha to the storage section 22 (FIG. 5). In this case, for example, two condensers that condense vapor of crude naphtha discharged from the first distillation column 11 are provided, the antioxidant treatment section 12 is provided in one condenser, and liquid crude naphtha discharged from the other condenser is supplied to the hydrotreating section 16. In the hydrotreating section 16, renewable hydrogen is also used.

Figure 4:
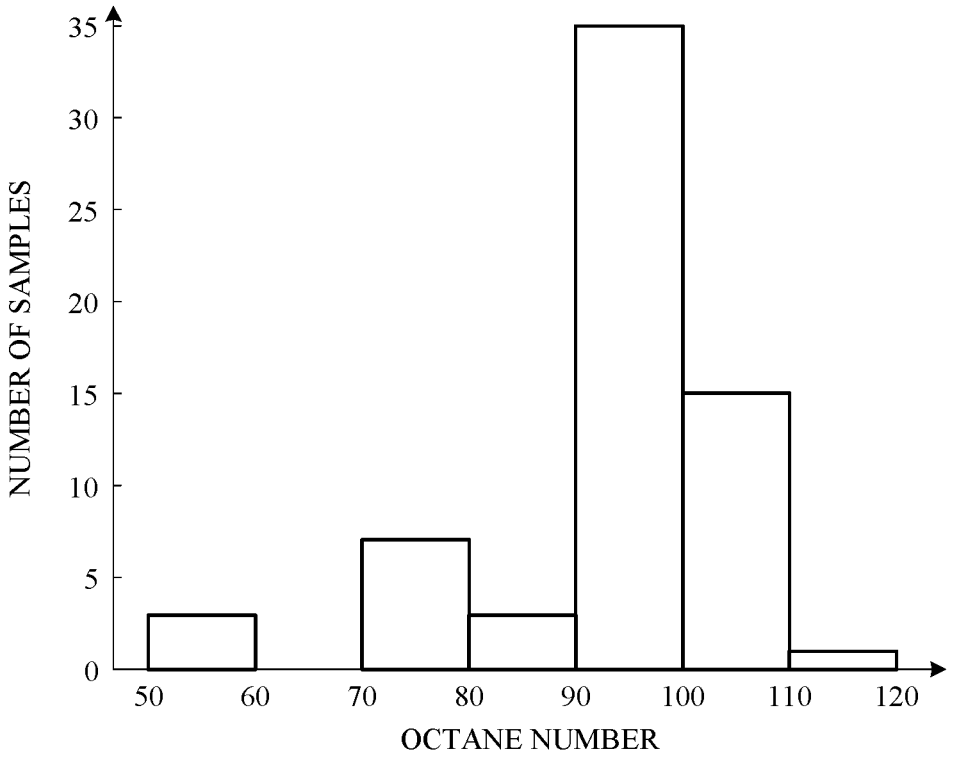
FIG. 4 is a diagram for explaining octane number of crude naphtha fractionated in a first distillation column of FIGS. 3A and 3B.

FIG. 4 is a diagram for explaining the octane number of the crude naphtha fractionated in the first distillation column 11, and illustrates the octane number of a typical olefin having 5 to 9 carbon atoms. As illustrated in FIG. 4, an average octane number of typical olefins having 5 to 9 carbon atoms is about 93, which is higher than the octane number of the entire naphtha (about 50 to 80). Therefore, the octane number of the low boiling point lower olefin (5 to 9 carbon atoms) contained in the crude naphtha fraction is higher than the octane number of the entire naphtha, and when the mixing ratio of such olefins is increased, the octane number can be improved regardless of the presence or absence of the synergistic effect.

FIG. 5 is a block diagram illustrating an example of a configuration of a mixing unit 20 of the apparatus 100. As illustrated in FIGS. 3A, 3B, and 5, the apparatus 100 includes the fractionation units 10 and 10A that fractionate the FT crude oil and perform required treatment, and the mixing unit 20 for mixing the FT naphtha containing olefins and the FT naphtha containing no olefins that are fractionated and treated in the fractionation units 10 and 10A.

As illustrated in FIG. 5, the mixing unit 20 includes storage sections 21, 22, and 23, mixers 24 and 27, an olefin content/octane number measurement section 25, a catalytic reforming section 26, and an octane number measurement section 28. The storage section 21 is supplied with and stores the FT naphtha containing olefins to which the antioxidant is added by the antioxidant treatment section 12. The storage section 22 is supplied with and stores the FT naphtha containing no olefins fractionated in the second distillation column 15 and the FT naphtha containing no olefins hydrogenated in the hydrotreating section 16. The storage section 23 stores bioethanol produced from biomass such as corn.

The storage sections 21 and 22 and the mixer 24 are connected via a pipe R10, FT naphtha containing olefins is supplied from the storage section 21 to the mixer 24 through the pipe R10, and FT naphtha containing no olefins is supplied from the storage section 22 to the mixer 24. The FT naphtha containing olefins from the storage section 21 and the FT naphtha containing no olefins from the storage section 22 are mixed in the pipe R10 and the mixer 24, thereby obtaining a mixed fuel.

A pipe R11 connecting the storage section 21 and the mixer 24 is provided with a regulating valve 21*a* that regulates a supply amount of the FT naphtha containing olefins, which is supplied from the storage section 21 to the mixer 24 and becomes a part of the mixed fuel. A pipe R12 connecting the storage section 22 and the mixer 24 is provided with a regulating valve 22*a* that regulates a supply amount of the FT naphtha containing no olefins, which is supplied from the storage section 22 to the mixer 24 and becomes a part of the mixed fuel. The regulating valves 21*a* and 22*a* may be manually operated or may be controlled by a computer 29. Hereinafter, the antioxidant treatment section 12 (FIGS. 3A and 3B), the storage section 21, and the regulating valve 21*a* may be referred to as a first supply unit that supplies the FT naphtha containing olefins to the mixer 24. In addition, the hydrotreating section 16 (FIG. 3B), the storage section 22, and the regulating valve 22*a* may be referred to as a second supply unit that supplies the FT naphtha containing no olefins to the mixer 24.

The pipe R10 connecting the storage sections 21 and 22 and the mixer 24 is provided with the olefin content/octane number measurement section 25 that measures an olefin content and an octane number of the mixed fuel. The olefin content/octane number measurement section 25 includes a measuring instrument such as a near-infrared spectrometer, measures the olefin content and the octane number of the mixed fuel flowing through the pipe R10, and outputs a measurement result to a display or a computer for controlling the regulating valve. In the olefin content/octane number measurement section 25, the mixed fuel flowing through the pipe R10 may be collected and the octane number may be measured by a combustion test.

As illustrated in FIG. 2, the larger the difference ARON between the octane number predicted according to the octane number and the mixing ratio of the base material and the additive indicated by the broken line and the actual octane number of the mixed fuel indicated by the solid line, the greater the synergistic effect when mixing olefins with the FT naphtha base material. Since the synergistic effect when the olefins are mixed with the FT naphtha base material is maximized when the mixing ratio of the olefins is 50 vol %, the mixing ratio of the olefins is preferably 50 vol % or less from the viewpoint of efficiently improving the octane number of the mixed fuel. In addition, when the mixing ratio of the olefins is excessive, a non-volatile gum is produced, and thus, the mixing ratio of the olefins is preferably about 10 to 25 vol %.

The regulating valves 21*a* and 22*a* are operated to regulate the supply amounts of the FT naphtha containing olefins and the FT naphtha containing no olefins so that the octane number corresponds to the gasoline standard (about 90) within a range in which the olefin content measured by the olefin content/octane number measurement section 25 is about 10 to 25 vol %. As a result, even FT naphtha having a wide range in properties such as an octane number can be adjusted to an octane number corresponding to the gasoline standard. In addition, the octane number can be efficiently improved by the synergistic effect due to mixing of naphtha and olefins.

The storage section 23 and the mixer 24 are connected via a pipe R20, and the bioethanol is supplied from the storage section 23 to the mixer 24 through the pipe R20. The bioethanol from the storage section 23 is added to and mixed with the mixed fuel of FT naphtha containing olefins and FT naphtha containing no olefins in the mixer 24. The pipe R20 connecting the storage section 23 and the mixer 24 is provided with a regulating valve 23*a* that regulates the amount of bioethanol supplied from the storage section 23 to the mixer 24. The regulating valve 23*a* may be manually operated or may be controlled by the computer 29.

The storage section 22 and the mixer 24 are further connected via a pipe R30. The pipe R30 is provided with the catalytic reforming section 26, FT naphtha containing no olefins is supplied from the storage section 22 to the catalytic reforming section 26 through the pipe R30, and reformed gasoline after the catalytic reforming is supplied from the catalytic reforming section 26 to the mixer 24 through the pipe R30. The catalytic reforming section 26 performs catalytic reforming (cyclodehydrogenation reaction) of FT naphtha containing no olefins to produce reformed gasoline containing an aromatic hydrocarbon such as toluene. In the FT naphtha containing no olefins stored in the storage section 22, for example, only heavy naphtha having a low octane number separated by distillation may be supplied to the catalytic reforming section 26 for reforming. The pipe R30 provided between the storage section 22 and the catalytic reforming section 26 is provided with a regulating valve 22*b* that regulates the supply amount of the FT naphtha containing no olefins supplied from the storage section 22 to the catalytic reforming section 26, that is, the supply amount of the reformed gasoline reformed by the catalytic reforming section 26 and supplied to the mixer 24. The regulating valve 22*b* may be manually operated or may be controlled by the computer 29.

In a case where the octane number of the mixed fuel measured by the olefin content/octane number measurement section 25 does not reach the gasoline standard, the regulating valves 23*a* and 22*b* are operated to regulate the supply amounts of bioethanol and reformed gasoline so that the octane number of the mixed fuel meets the gasoline standard. The amounts of bioethanol and reformed gasoline added with respect to the mixed fuel are calculated based on a characteristic map set in advance by a test according to the octane number of the mixed fuel before addition. By calculating an appropriate addition amount based on a characteristic map set in advance by a test, bioethanol and reformed gasoline are not excessively added, and olefins in the mixed fuel are not excessively diluted.

As illustrated in FIG. 2, similar to olefins, the synergistic effect when mixing ethanol with the FT naphtha base material is maximum when a mixing ratio is 50 vol %, and therefore, the mixing ratio of bioethanol is preferably 50 vol % or less from the viewpoint of efficiently improving the octane number. In addition, when a mixing ratio of alcohols is excessive, a calorific value decreases, and thus, the mixing ratio of the bioethanol is 20 vol % or less and preferably 10 vol % or less. In this case, a content of the FT naphtha in the mixed fuel is 50% or more. As a result, the octane number of the mixed fuel can be more reliably adjusted to the gasoline standard, and the octane number can be efficiently improved by the synergistic effect by mixing naphtha and ethanol.

The mixer 27 is connected downstream of the mixer 24 via a pipe R40, the bioethanol and reformed gasoline are added to the mixer 24, and the mixed fuel is supplied to the mixer 27 through the pipe R40. The pipe R40 connecting the mixer 24 and the mixer 27 is provided with the octane number measurement section 28 that measures the octane number of the mixed fuel. The octane number measurement section 28 includes a measuring instrument such as a near-infrared spectrometer, measures the octane number of the mixed fuel flowing through the pipe R40, and outputs a measurement result to the display or the computer 29. In the octane number measurement section 28, the mixed fuel flowing through the pipe R40 may be collected and the octane number may be measured by a combustion test.

The catalytic reforming section 26 is further connected to the mixer 24 via a pipe R50, and the reformed gasoline reformed by the catalytic reforming section 26 is supplied to mixer 27 through the pipe R50. The pipe R50 provided between the catalytic reforming section 26 and the mixer 27 is provided with a regulating valve 26*b* that regulates the amount of reformed fuel supplied from the catalytic reforming section 26 to the mixer 27. The regulating valve 26*b* may be manually operated or may be controlled by the computer 29.

In a case where the octane number of the mixed fuel measured by the octane number measurement section 28 does not reach the gasoline standard, the regulating valve 26*b* is operated to regulate the supply amount (additional supply amount) of reformed gasoline so that the octane number of the mixed fuel meets the gasoline standard. As a result, the octane number of the mixed fuel can be more reliably adjusted to the gasoline standard.

Figure 6:
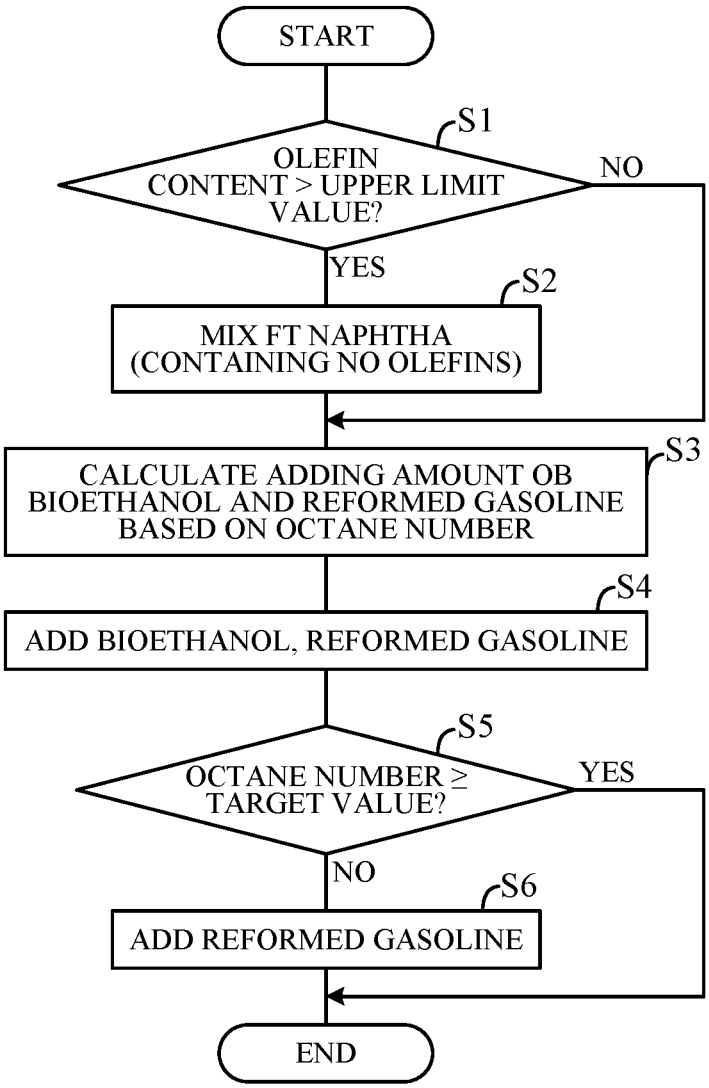
FIG. 6 is a flowchart illustrating an example of a gasoline production method according to the embodiment of the present invention.

FIG. 6 is a flowchart illustrating an example of a method of producing gasoline according to the embodiment of the present invention. Each step in FIG. 6 may be performed manually or automatically by the computer 29. As illustrated in FIG. 6, first, in S1 (S: processing step), it is determined whether or not the content of olefins in the mixed fuel measured by the olefin content/octane number measurement section 25 exceeds the upper limit value. In a case where the determination is positive in S1, the processing proceeds to S2, and in a case where the determination is negative in S1, the processing proceeds to S3. In S2, the regulating valves 21*a* and 22*a* are operated so as to increase the mixing ratio of the FT naphtha containing no olefins until the olefin content measured by the olefin content/octane number measurement section 25 reaches the upper limit value. In S3, the amount of bioethanol added and the amount of reformed gasoline added corresponding to the octane numbers measured by the olefin content/octane number measurement section 25 are calculated with reference to a preset characteristic map. In S4, the regulating valves 23*a* and 22*b* are operated so as to add bioethanol and reformed gasoline in amounts calculated in S3 to the mixed fuel. Next, in S5, it is determined whether or not the octane number of the mixed fuel to which the bioethanol and the reformed gasoline are added, which is measured by the octane number measurement section 28, is equal to or more than a target value. In a case where the determination is positive in S5, the processing ends, and when the determination is negative in S5, the processing proceeds to S6. In S6, referring to a characteristic map set in advance, the amount of reformed gasoline added corresponding to the octane number measured by the octane number measurement section 28 is calculated, and the regulating valve 26*b* is operated to add the calculated amount of reformed gasoline.

According to the present embodiment, the following operations and effects are achievable.

(1) The apparatus 100 includes the mixer 24 for mixing FT naphtha containing olefins and FT naphtha containing no olefins so as to have a predetermined olefin content (FIG. 5). As described above, the FT naphtha containing olefins and the FT naphtha containing no olefins are mixed to adjust an olefin content ratio, such that gasoline having a desired octane number can be produced from the FT naphtha as a renewable fuel having a range of properties such as an octane number. In this case, the octane number can be efficiently improved due to the synergistic effect when mixing naphtha and olefins (FIG. 2).

(2) The apparatus 100 includes the first supply unit (the antioxidant treatment section 12, the storage section 21, and the regulating valve 21*a*) for supplying crude naphtha obtained by fractionating FT crude oil subjected to FT synthesis to the mixer 24 as FT naphtha containing olefins without hydrogenation and the second supply unit (the hydrotreating section 16, the storage section 22, and the regulating valve 22*a*) for hydrogenating the crude naphtha and supplying the hydrogenated naphtha to the mixer 24 as FT naphtha containing no olefins (FIGS. 3B and 5). As described above, gasoline can be easily and efficiently produced by using crude naphtha as a mixed fuel without hydrogenation that is usually performed.

(3) The first supply unit adds an antioxidant to the crude naphtha and supplies the crude naphtha to which the antioxidant is added to the mixer 24 as FT naphtha containing olefins (FIGS. 3A, 3B, and 5). By adding an antioxidant to the crude naphtha having extremely low oxidation stability instead of hydrogenation, it is possible to suppress a decrease in olefins due to oxidation and to suppress a decrease in octane number.

(4) Gasoline produced by the apparatus 100 has a naphtha content of 50% or more, an olefin content of 10% or more and 25% or less, and an ethanol content of 20% or less. As described above, a mixing ratio of olefins or ethanol to naphtha can be reduced by determining the mixing ratio within a range in which a synergistic effect is obtained when naphtha and olefins, and naphtha and ethanol are mixed. In addition, olefins are preferentially mixed rather than ethanol, such that it is possible to suppress a decrease in calorific value due to the addition of alcohols.

The above embodiment can be combined as desired with one or more of the aforesaid modifications. The modifications can also be combined with one another.

According to the present invention, it becomes possible to efficiently produce gasoline as a renewable fuel.

Above, while the present invention has been described with reference to the preferred embodiments thereof, it will be understood, by those skilled in the art, that various changes and modifications may be made thereto without departing from the scope of the appended claims.

Example 1

A mixed fuel was prepared by mixing 52 vol % of PRF50 having an octane number of 50 obtained by mixing isooctane and normal heptane at a volume ratio of 50:50, 10 vol % of ethanol, 18 vol % of diisobutylene, and 20 vol % of toluene. The octane number of the prepared mixed fuel was 92.5.

Example 2

A mixed fuel was prepared by mixing 62 vol % of PRF50, 10 vol % of ethanol, 18 vol % of diisobutylene, and 10 vol % of toluene. The octane number of the prepared mixed fuel was 86.5.

Example 3

A mixed fuel was prepared by mixing 80 vol % of PRF65 having an octane number of 65 obtained by mixing isooctane and normal heptane at a volume ratio of 65:35, 10 vol % of ethanol, and 10 vol % of diisobutylene. The octane number of the prepared mixed fuel was 89.7.

Example 4

A mixed fuel was prepared by mixing 90 vol % of PRF80 having an octane number of 80 obtained by mixing isooctane and normal heptane at a volume ratio of 80:20 and 10 vol % of ethanol. The octane number of the prepared mixed fuel was 89.4.

In Examples 1 to 4, it was confirmed that a mixed fuel corresponding to gasoline standard (about 90) was prepared by mixing ethanol, diisobutylene, and toluene at appropriate ratios with respect to PRF having an octane number of 50 to 80 assumed as FT naphtha.

The invention claimed is:

1. A gasoline production apparatus, comprising:
- a mixer configured to mix first FT naphtha containing olefins and second FT naphtha containing no olefins to produce mixed fuel having a predetermined olefin content;
- a first supply unit configured to supply crude naphtha obtained by fractionating FT crude oil subjected to FT synthesis to the mixer as the first FT naphtha without hydrogenation; and
- a second supply unit configured to hydrogenate the crude naphtha and configured to supply the hydrogenated crude naphtha to the mixer as the second FT naphtha.

2. The gasoline production apparatus according to claim 1, wherein
- the first supply unit adds an antioxidant to the crude naphtha and supplies the crude naphtha added with the antioxidant to the mixer as the first FT naphtha.

3. The gasoline production apparatus according to claim 1, further comprising:
- an olefin content measuring instrument configured to measure an olefin content of the mixed fuel.

4. The gasoline production apparatus according to claim 3, further comprising:
- an octane number measuring instrument configured to measure an octane number of the mixed fuel.

5. A gasoline production method, comprising the step of:
- mixing first FT naphtha containing olefins and second FT naphtha containing no olefins to produce mixed fuel having a predetermined olefin content, wherein
- the mixing includes:
  - mixing crude naphtha obtained by fractionating FT crude oil subjected to FT synthesis as the first FT naphtha without hydrogenation;
  - hydrogenating the crude naphtha; and
  - mixing the hydrogenated crude naphtha as the second FT naphtha.

6. The gasoline production method according to claim 5, wherein
- the mixing the crude naphtha without hydrogenation includes:
  - adding an antioxidant to the crude naphtha; and
  - mixing the crude naphtha added with the antioxidant as the first FT naphtha.

7. A gasoline produced by the gasoline production apparatus according to claim 1, containing:
- 50% or more of naphtha;
- 10% or more and 25% or less of olefin; and
- 20 vol % or less of ethanol.

8. A gasoline produced by the gasoline production method according to claim 5, containing:
- 50% or more of naphtha;
- 10% or more and 25% or less of olefin; and
- 20 vol % or less of ethanol.

* * * * *